US009244418B2

(12) United States Patent
Yokoyama

(10) Patent No.: US 9,244,418 B2
(45) Date of Patent: Jan. 26, 2016

(54) IMAGE FORMING APPARATUS

(71) Applicant: CANON KABUSHIKI KAISHA, Tokyo (JP)

(72) Inventor: Seiji Yokoyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/302,266

(22) Filed: Jun. 11, 2014

(65) Prior Publication Data

US 2014/0369702 A1 Dec. 18, 2014

(30) Foreign Application Priority Data

Jun. 14, 2013 (JP) ..... 2013-125714

(51) Int. Cl.
*G03G 15/23* (2006.01)
*G03G 15/00* (2006.01)

(52) U.S. Cl.
CPC ..... *G03G 15/5062* (2013.01); *G03G 15/234* (2013.01); *G03G 15/6573* (2013.01); *G03G 2215/00945* (2013.01)

(58) Field of Classification Search
CPC ..... G03G 15/5062; G03G 15/5058
USPC ..... 399/15
See application file for complete search history.

(56) References Cited

U.S. PATENT DOCUMENTS

2006/0093386 A1* 5/2006 Oki ..... 399/49
2007/0189789 A1* 8/2007 Suzuki ..... 399/49

FOREIGN PATENT DOCUMENTS

JP 2003131538 A * 5/2003 ..... G03G 21/14
JP 2005-212972 A 8/2005
JP 2005-283898 A 10/2005
JP 2007-163700 A 6/2007
JP 2012-198367 A 10/2012
JP 2013-080129 A 5/2013

* cited by examiner

*Primary Examiner* — David Gray
*Assistant Examiner* — Sevan A Aydin
(74) *Attorney, Agent, or Firm* — Canon USA, Inc. IP Division

(57) ABSTRACT

An image forming apparatus includes a forming unit configured to form a detection patch on a recording material and a detecting unit configured to detect the detection patch on the recording material being conveyed at a first conveying speed. After the detecting unit detects the detection patch, the recording material with the detected detection patch is conveyed at a second conveying speed higher than the first conveying speed.

23 Claims, 15 Drawing Sheets

IMAGE FORMING APPARATUS

BACKGROUND

1. Field

Aspects of the present invention generally relate to image forming apparatuses, such as color printers and color copiers, and in particular to an image forming apparatus including a colorimeter.

2. Description of the Related Art

In recent years, image forming apparatuses, typified by a color printer and a color copier, has required an enhanced image quality in output images. In particular, stability of chromaticity of output images has a profound effect on the quality of the images. However, changes in environment, such as temperature or humidity, or a long period of use may vary the chromaticity of an obtained output image in an image forming apparatus. One effective approach to achieve stable chromaticity of output images is to detect the chromaticity of an output image using a colorimeter and perform color correction control according to the detected chromaticity.

One example method for detecting chromaticity of an output image is disclosed in Japanese Patent Laid-Open No. 2005-283898. The method is the one of forming a color patch on a recording material and colorimetrically measuring color of the color patch using a colorimeter while conveying the recording material with the color patch formed thereon. During the colorimetric measurement, the conveying speed of the recording material is lower than a printing speed, thus improving the accuracy of the colorimetric measurement.

However, reducing the conveying speed of the recording material with the color patch subjected to the colorimetric measurement by the colorimeter serving as a detecting unit can improve the accuracy of the colorimetric measurement, but requires a longer period of time taken for discharging the recording material with the color patch formed thereon. This extends the time taken for completing a calibration operation using the detecting unit and raises a problem in that the extended time leads to downtime.

SUMMARY OF THE INVENTION

Aspects of the present invention are generally directed to reducing the time taken for calibration.

According to an aspect of the present invention, an image forming apparatus includes a forming unit configured to form a detection patch on a recording material and a detecting unit configured to detect the detection patch on the recording material being conveyed at a first conveying speed. After the detecting unit detects the detection patch, the recording material with the detected detection patch is conveyed at a second conveying speed higher than the first conveying speed.

Further features of the present disclosure will become apparent from the following description of exemplary embodiments with reference to the attached drawings.

DESCRIPTION OF THE EMBODIMENTS

Exemplary embodiments are described below with reference to the drawings. These exemplary embodiments are not seen to be limiting. Not all of the combinations of characteristics described in the embodiments are necessary to implement the embodiments.

First Embodiment

Description of Image Forming Apparatus

Figure 1:
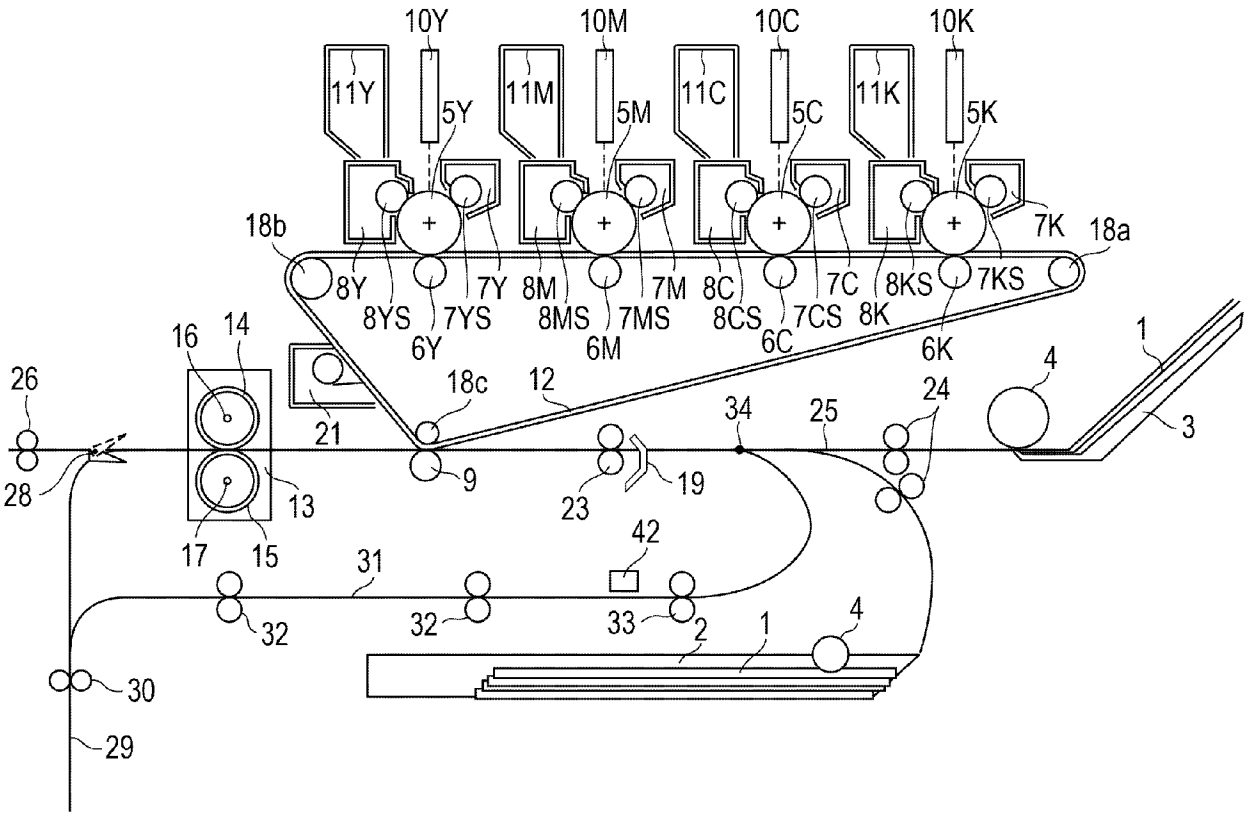
FIG. 1 is a schematic diagram of an image forming apparatus.

FIG. 1 is a schematic diagram of an image forming apparatus according to the present embodiment. The elements having reference numerals with the suffixes Y, M, C, and K in FIG. 1 indicate the elements for use in forming yellow, magenta, cyan, and black toner images on an intermediate transfer belt 12, respectively. In the following description, when it is not necessary to distinguish among the colors, the reference numerals without the suffixes Y, M, C, and K are used.

A photosensitive drum 5 is the one in which an organic photoconductive layer is applied to the outer periphery of an aluminum cylinder and is rotated in a counterclockwise direction by a driving motor (not illustrated). A charger 7 includes charging sleeves 7YS, 7MS, 7CS, and 7KS for primarily charging the photosensitive drum 5. A laser scanner 10 forms an electrostatic latent image on the surface of the photosensitive drum 5 charged to a constant potential by the charger 7 by selectively radiating that surface with a laser beam on the basis of input image data. A developing device 8 includes developing sleeves 8YS, 8MS, 8CS, and 8CK for visualizing the formed electrostatic latent images. The electrostatic latent images on the photosensitive drum 5 are developed as toner images by the developing device 8.

The intermediate transfer belt 12 as an intermediate transfer member is an endless belt placed around a driving roller 18*a* and driven rollers 18*b* and 18*c*. The intermediate transfer belt 12 rotates in contact with the photosensitive drum 5 in a clockwise direction in synchronization with the photosensitive drum 5. The toner images on the photosensitive drum 5 are primarily transferred to the intermediate transfer belt 12 sequentially by a primary transfer roller 6 and thus become a multicolor toner image.

Recording materials 1 as paper are accommodated in feed trays 2 and 3. The recording materials 1 are fed by feed rollers 4 and conveyed on a conveying path 25 by conveying rollers 24. When one of the recording materials 1 reaches a registration sensor 19, acceleration and deceleration of the recording material 1 is controlled by a registration roller 23 such that the timing of conveying the recording material 1 matches with the toner image on the intermediate transfer belt 12.

The multicolor toner image on the intermediate transfer belt 12 is conveyed to a secondary transfer portion including the driven roller 18*c* and a secondary transfer roller 9. The conveyance of the recording material 1 to the secondary transfer portion matches with the conveyance of the multicolor toner image. The multicolor toner image on the intermediate transfer belt 12 is secondarily transferred to the recording material at the secondary transfer portion. A cleaner container 21 holds residual toner that was not secondarily transferred and thus remained on the intermediate transfer belt 12 by cleaning it using a cleaning blade.

A fixing device 13 fixes the multicolor toner image transferred at the secondary transfer portion on the recording material 1. The fixing device 13 includes a fixing roller 14 for heating the recording material 1 and a pressing roller 15 for pressing the recording material 1 into contact with the fixing roller 14. The fixing roller 14 and the pressing roller 15 are hollow and incorporate heaters 16 and 17, respectively. The recording material 1 with the secondarily transferred multicolor toner image is conveyed to the fixing device 13 and subjected to heat and pressure by the fixing roller 14 and the pressing roller 15, and thus the multicolor toner image is fixed.

In the case of single-sided image forming, the recording material 1 with the fixed toner image is discharged by a discharge roller 26, and an image forming operation is completed. In the case of duplex image forming, the recording material 1 with the fixed toner image is conveyed to a duplex conveying path by a duplex flapper 28. The recording material 1 is switched back by a switch-back mechanism 29 and a duplex reversing roller 30. The recording material 1 is conveyed along the duplex conveying path by duplex conveying rollers 32 and a duplex re-feed roller 33. After that, to form an image on the back side, the recording material 1 passes through a merging location 34 at which the single-sided conveying path and the duplex conveying path meet and is conveyed to the registration roller 23 again. The above-described photosensitive drum 5, charger 7, laser scanner 10, developing device 8, intermediate transfer belt 12, primary transfer roller 6, secondary transfer roller 9, and other elements can also be referred to collectively as an image forming unit.

A color sensor 42 as a detecting unit colorimetrically measures color of each of single-color tone patches corresponding to cyan (C), magenta (M), yellow (Y), and black (K) or color of each of a gray tone patch formed by mixing C, M, and Y and a single-color tone patch corresponding to K. The color sensor 42 is disposed on a duplex conveying path 31 to colorimetrically measure color of each of the single-color tone patches and the gray tone patch. In the present embodiment, the color sensor 42 is disposed on the duplex conveying path 31. Other examples may also be used. The color sensor 42 may be disposed in any location on the conveying path downstream of the fixing device 13. For example, the color sensor 42 may be disposed between the fixing device 13 and the discharge roller 26. The color sensor 42 faces a surface of the recording material 1 on which an image is formed and detects a color value of the fixed color patch on the recording material 1. That is, the color patch is a detection patch to be detected by the color sensor 42.

Configuration of Color Sensor 42

Figure 2:
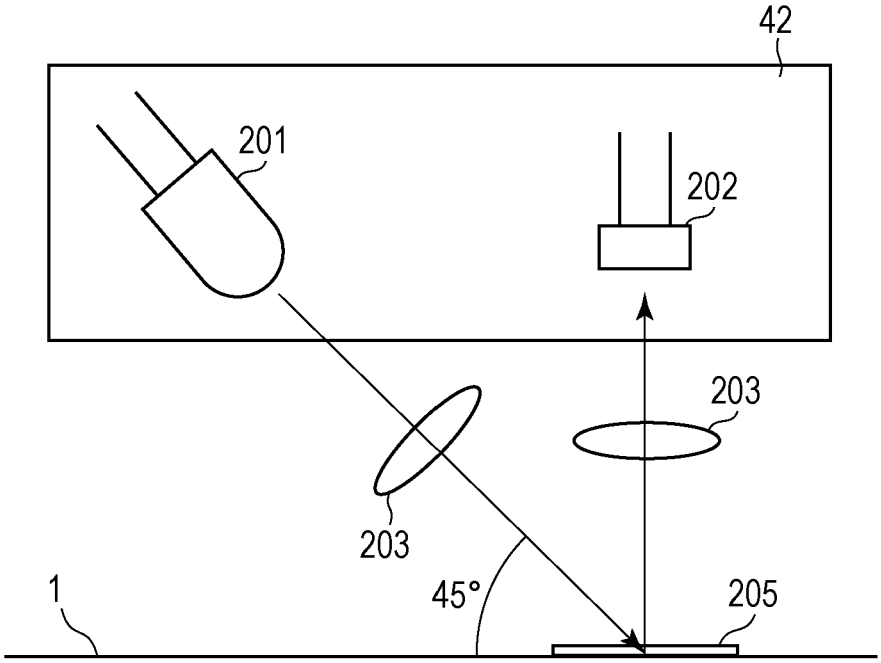
FIG. 2 is a schematic diagram of a color sensor.

FIG. 2 is a schematic diagram of the color sensor according to the present embodiment. The color sensor 42 includes an emitter 201, such as a light emitting diode (LED), a light detecting portion 202, such as a photodiode or a cadmium sulfide (Cds) cell, optical elements 203, an integrated circuit (IC) (not illustrated) for processing data about light received by the light detecting portion 202, and a holder for these elements. Although not illustrated, the light detecting portion 202 may be of the type of detecting spectrum obtained through a diffraction grating, the type of detecting light having passed through RGB color filters, or other types. Light emitted from the emitter 201 enters a color patch 205 formed on the recording material 1 at an angle of approximately 45° and is diffusely reflected at the color patch 205. The reflected light diffusely reflected at the color patch 205 is received by the light detecting portion 202, and a diffusely reflected component of the reflected light is sensed.

Block Diagram of Image Forming Apparatus

Figure 3:
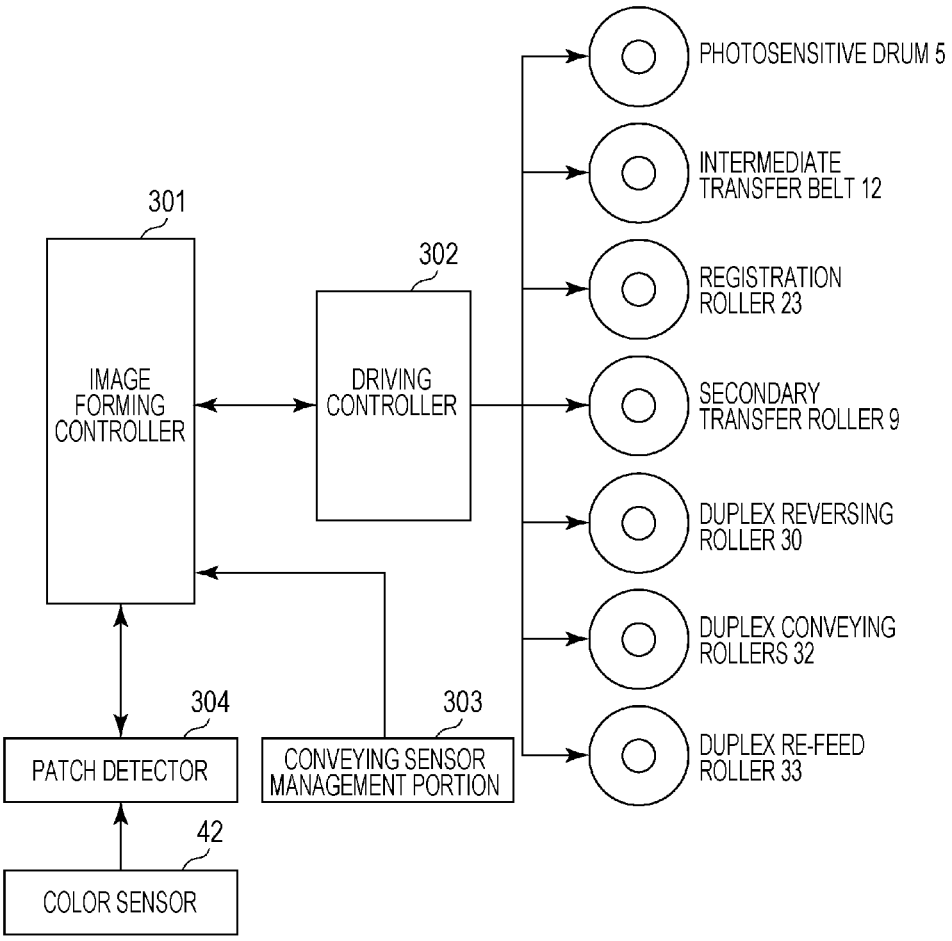
FIG. 3 is a block diagram of the image forming apparatus.

FIG. 3 is a block diagram of the image forming apparatus according to the present embodiment. An image forming controller 301 controls operations of the image forming apparatus. In image formation, the image forming controller 301 provides a driving instruction to a driving controller 302 and controls conveyance of the recording material 1 on the basis of information from the driving controller 302 or a conveying sensor management portion 303. The driving controller 302 controls driving and stopping of members for conveying the recording material 1, such as the photosensitive drum 5. The driving controller 302 detects the amount of diving of the members for conveying the recording material 1, such as the photosensitive drum 5, and informs the image forming controller 301 of the amount of driving.

The conveying sensor management portion 303 informs an output value from a sensor for detecting the presence or absence of the recording material 1, such as the registration sensor 19. A patch detector 304 transmits an instruction to detect the color patch 205 to the color sensor 42. The patch detector 304 informs the image forming controller 301 of detection of the color patch 205 by the color sensor 42.

Description of Color Patch

Figure 4:
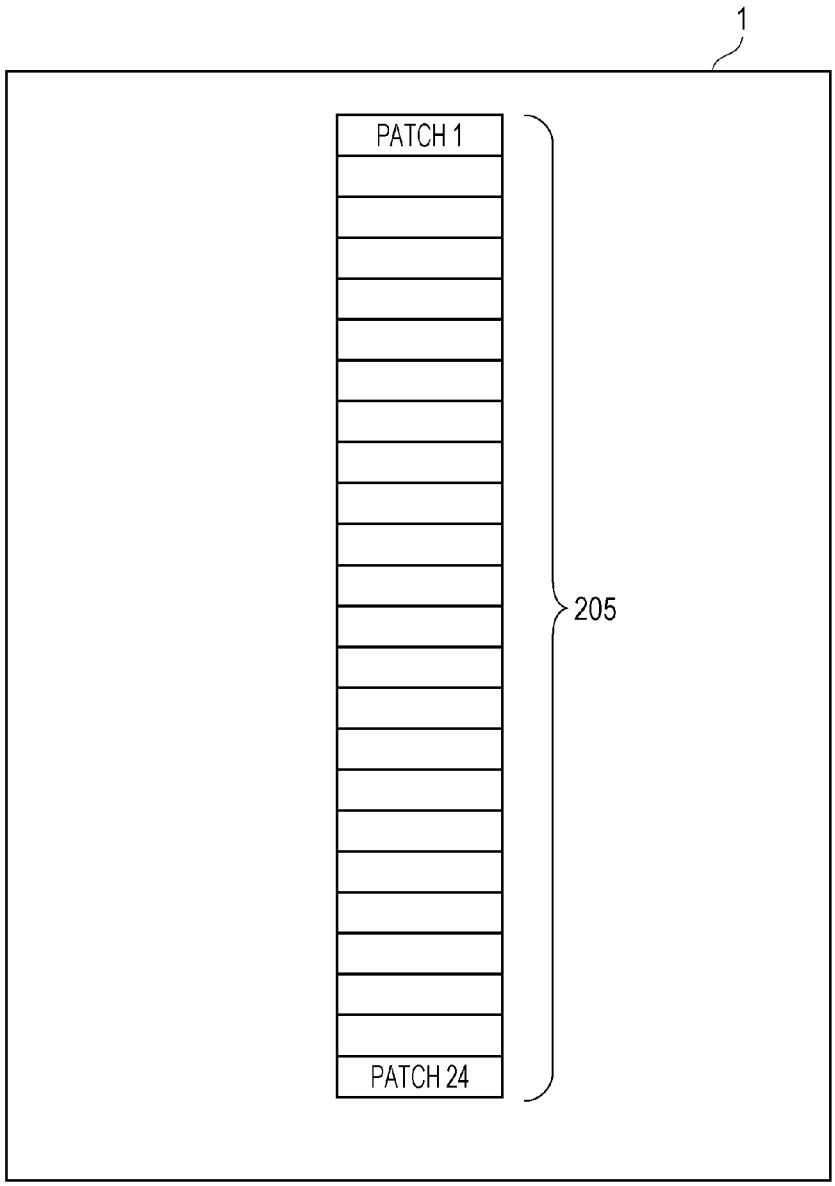
FIG. 4 illustrates a configuration of a color patch.

FIG. 4 illustrates a configuration of the color patch 205 as the detection patch in the present embodiment. The color patch 205 includes single-color patches corresponding to C, M, Y, and K or a mixed color patch of C, M, and Y. Each patch is formed in a continuous manner by changing density or chromaticity of the color. In the present embodiment, 24 patches consisting of patches 1 to 24 are formed on the recording material 1. Here, the color patch 205 made up of 24 patches is illustrated as one example. The number of the patches may be changed to any values depending on the desired detection accuracy.

Figure 5:
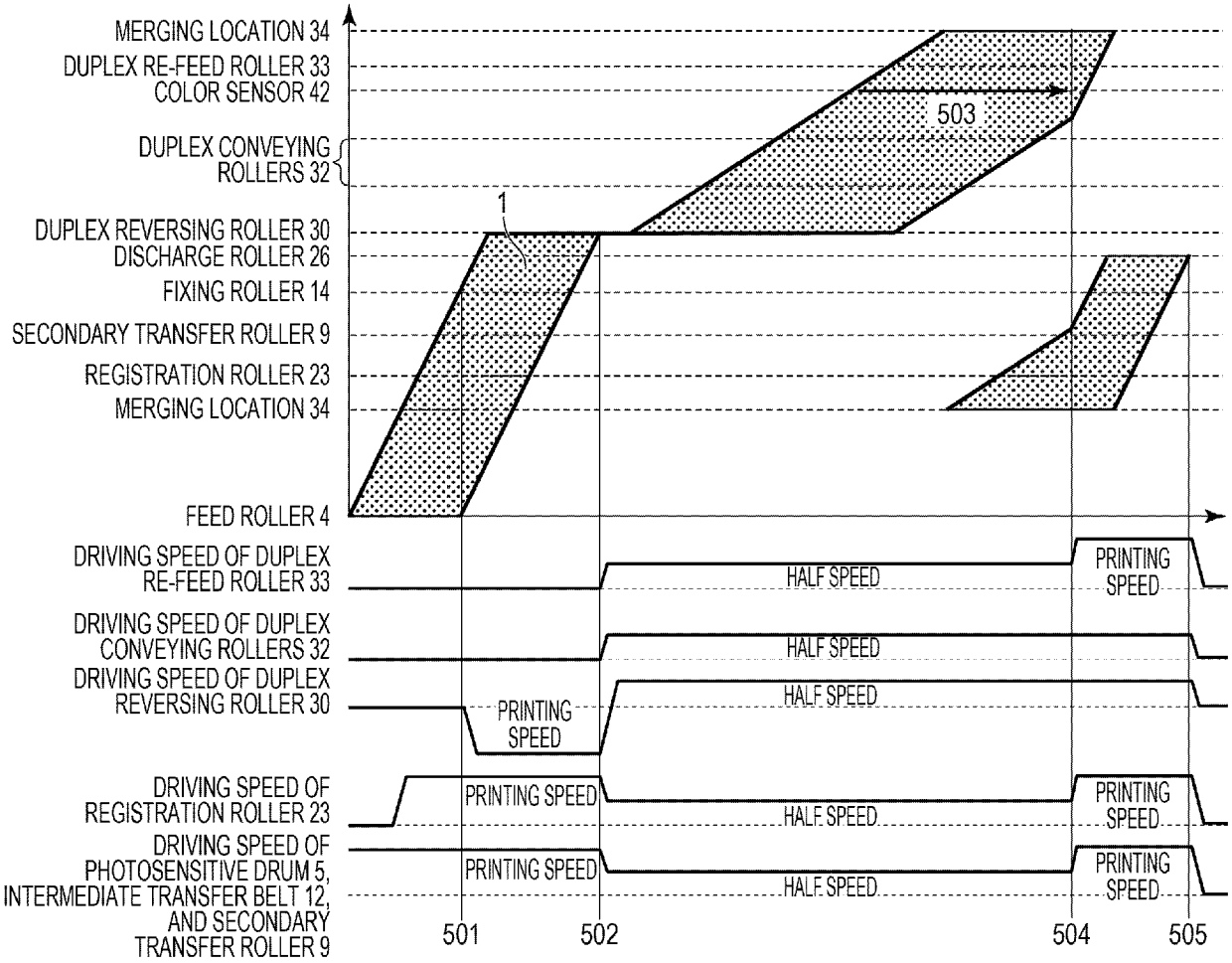
FIG. 5 illustrates a diagram and a timing chart for describing conveyance control for a recording material in detecting the color patch.

Description of Conveyance Control for Recording Material in Detecting Color Patch FIG. 5 illustrates a diagram and a timing chart for describing conveyance control for the recording material 1 in detecting the color patch 205 according to the present embodiment. In the diagram, the horizontal axis indicates the time and the vertical axis indicates the position of each roller in the image forming apparatus in FIG. 1. The diagram illustrates how the recording material 1 passes through each roller over time. The timing chart, which is illustrated below the diagram, illustrates the driving speed of each roller over time. In the present embodiment, the driving speed of each roller is set at a printing speed during image formation, whereas the driving speed of each roller is set at one-half the printing speed during detection of the color patch 205. In the following description and the drawings, the one-half of the printing speed may be referred to simply as the half speed.

At the beginning of color correction control, the image forming controller 301 drives the image forming unit at the printing speed and causes the color patch 205 to be formed on the recording material 1. At the time when the leading edge of the recording material 1 reaches the fixing device 13 (501), the duplex reversing roller 30 is driven at the printing speed. The recording material 1 with the color patch fixed by the fixing device 13 is conveyed to the switch-back mechanism 29 by the duplex flapper 28.

At the time when the trailing edge of the recording material 1 reaches the duplex reversing roller 30 (502), the rotational direction of the duplex reversing roller 30 is reversed. At this time, the driving speed of the duplex reversing roller 30 is set at one-half the printing speed. In addition, the driving speed of the duplex conveying rollers 32 and the duplex re-feed roller 33 is also set at one-half the printing speed, and the recording material 1 is conveyed to the duplex conveying path 31. At the same time, the driving speed of the photosensitive drum 5, the intermediate transfer belt 12, the secondary transfer roller 9, and the registration roller 23 is also switched to the half speed.

The color sensor 42 detects the color patch 205 on the recording material 1 being conveyed at one-half the printing speed (503). At the time when detecting the last patch 24 in the color patch 205 is completed (504), the image forming controller 301 switches the driving speed of the duplex re-feed roller 33, the photosensitive drum 5, the intermediate transfer belt 12, the secondary transfer roller 9, and the registration roller 23 to the printing speed. That is, the image forming controller 301 increases the driving speed from one-half the printing speed to the printing speed. The recording material 1 is conveyed at the printing speed, discharged to outside the image forming apparatus, and then the driving of the rollers is stopped (505). After that, the image forming condition is corrected on the basis of detection by the color sensor 42, and the color correction control is completed.

Flowchart of Conveyance Control for Recording Material in Detecting Color Patch

The color correction control according to the present embodiment is described below with reference to the flowchart in FIG. 6. At S101, when the color correction control is started, the image forming controller 301 causes the feed rollers 4 to be rotated and starts conveying the recording material 1. At S102, the image forming controller 301 causes the color patch 205 to be formed on the intermediate transfer belt 12. At S103, the image forming controller 301 causes the color patch 205 on the intermediate transfer belt 12 to be transferred to the recording material 1 conveyed to the secondary transfer portion.

At S104, the image forming controller 301 causes the fixing device 13 to fix the transferred color patch 205 on the recording material 1. At S105, the image forming controller 301 determines whether the trailing edge of the recording material 1 with the color patch 205 fixed by the fixing device 13 has been conveyed to the duplex reversing roller 30. Whether the trailing edge of the recording material 1 has been conveyed to the duplex reversing roller 30 can be determined from the conveying speed and conveying time of the recording material 1 or an output of a duplex reversing sensor (not illustrated). After the trailing edge of the recording material 1 is conveyed to the duplex reversing roller 30, at S106, the image forming controller 301 switches the conveying speed of the recording material 1 to one-half the printing speed. The recording material 1 is conveyed to the color sensor 42 at one-half the printing speed.

At S107, the image forming controller 301 causes the color sensor 42 to detect the color patch 205 on the recording material 1. At S108, the image forming controller 301 determines whether the trailing edge of the color patch 205 has been detected by the color sensor 42. Whether the trailing edge of the color patch 205 has been detected can be determined from determination whether the color sensor 42 has detected the same number of the patches as that in the color patch 205 on the recording material 1. After the trailing edge of the color patch 205 is detected, at S109, the image forming controller 301 switches the conveying speed of the recording material 1 to the printing speed. At S110, the image forming controller 301 causes the recording material 1 conveyed at the printing speed to be discharged to outside the image forming apparatus. The image forming controller 301 corrects the image forming condition on the basis of the detection by the color sensor 42 and completes the color correction control.

Here, as one example, when the trailing edge of the recording material 1 is conveyed to the duplex reversing roller 30, the conveying speed of the recording material 1 is switched to one-half the printing speed. Other examples may also be used. Any timing other than the timing when the trailing edge of the recording material 1 is conveyed to the duplex reversing roller 30 may also be used as long as the conveying speed is switched before the color patch 205 on the recording material 1 is detected by the color sensor 42. Here, as one example, the conveying speed of the recording material 1 is switched to one-half the printing speed. Other examples may also be used. The recording material 1 may also be conveyed at any conveying speed other than one-half the printing speed as long as the color sensor 42 is able to detect the color patch 205 with desired accuracy.

Here, as one example, the conveying speed of the recording material 1 after the detection by the color sensor 42 is switched to the printing speed. Other examples may also be used. For example, the recording material 1 may be conveyed at any speed higher than the printing speed and discharged. These variations are also applicable to the embodiments described below.

As described above, in detecting the color patch 205 on the recording material 1 by the color sensor 42, the conveying speed of the recording material 1 is switched to one-half the printing speed. When the trailing edge of the color patch 205 on the recording material 1 is detected by the color sensor 42, the conveying speed of the recording material 1 is switched to the printing speed. Accordingly, the color patch 205 can be detected by the color sensor 42 with high accuracy, and the time required for calibration including the detecting operation by the color sensor 42 can be reduced.

Second Embodiment

In the above first embodiment, a method of forming a color patch on a single recording material and detecting the color patch using the color sensor is described. Depending on the size of the used recording material, there may be cases where because it is difficult to contain the patches whose number is necessary for the desired detection accuracy on a single recording material, the color patch is formed on a plurality of recording materials. In the present embodiment, a method of forming a color patch on a plurality of recording materials and detecting the color patch on each of the recording materials using the color sensor is described. The configuration substantially the same as in the above first embodiment is not described here.

Description of Color Patch

Figure 7:
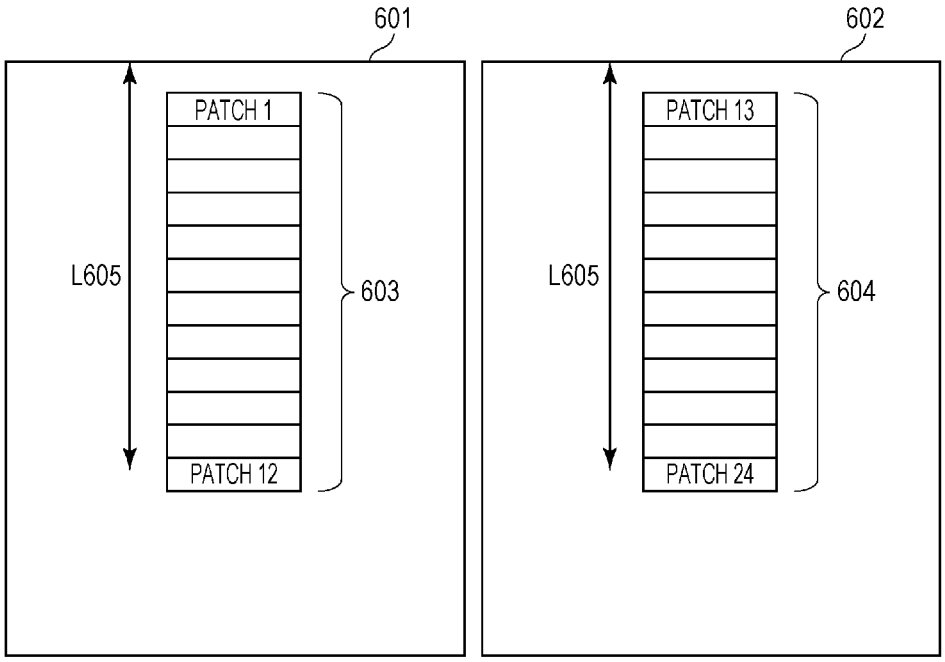
FIG. 7 illustrates a configuration of a color patch.

FIG. 7 illustrates a configuration of a color patch in the present embodiment. In the present embodiment, a method of forming a color patch on two recording materials is described as one example. The number of the recording materials on which the color patch is formed is not limited to two and may be more than two.

The color patch is divided into segments each having 12 patches and is formed on two recording materials. Here, for the sake of the description, the first recording material is referred to as a recording material 601, the segment of the color patch formed on the recording material 601 is referred to as a color patch 603, and the patches in the color patch 603 are referred to as patches 1 to 12. The second recording material is referred to as a recording material 602, the segment of the color patch formed on the recording material 602 is referred to as a color patch 604, and the patches in the color patch 604 are referred to as patches 13 to 24. Here, the color patch made up of 24 patches is illustrated as one example. The number of the patches may be changed to any values depending on the desired detection accuracy.

The distance L605 from the leading edge of the recording material 601 to the last patch 12 in the color patch 603 is shorter than the distance from the location where the color sensor 42 performs detection (hereinafter referred to as detection location of the color sensor 42) to the secondary transfer portion including the intermediate transfer belt 12 and the secondary transfer roller 9. The distance L605 from the leading edge of the recording material 602 to the last patch 24 in the color patch 604 is also shorter than the distance from the detection location of the color sensor 42 to the secondary transfer portion. This aims to prevent the recording material 601 from being conveyed to the secondary transfer portion during the detection of the color patch 603 on the recording material 601. Accordingly, it is not necessary to match the driving speed of the members relating to image formation, such as the intermediate transfer belt 12, with the conveying speed of the recording material 601 during the detection of the recording material 601.

Here, as one example, the length of the color patch 604 formed on the recording material 602 is also shorter than the distance from the detection location of the color sensor 42 to the secondary transfer portion. If there is no recording material to be conveyed subsequently to the recording material 602, a color patch longer than the distance L605 may also be formed.

Figure 8:
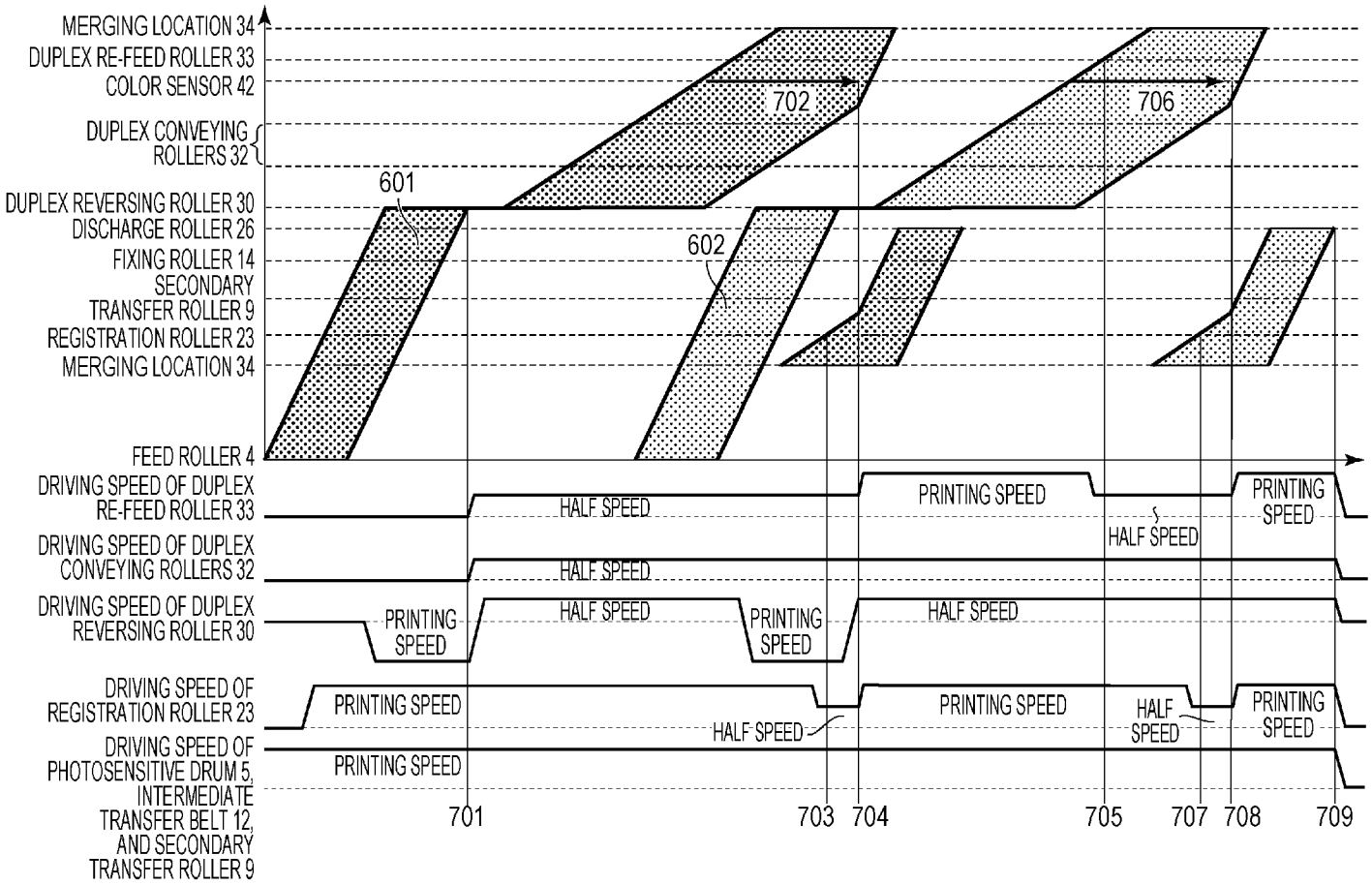
FIG. 8 illustrates a diagram and a timing chart for describing conveyance control for recording materials in detecting the color patch.

Description of Conveyance Control for Recording Materials in Detecting Color Patch FIG. 8 illustrates a diagram and a timing chart for describing conveyance control for the recording materials 601 and 602 in detecting the color patches 603 and 604. In the diagram, the horizontal axis indicates the time and the vertical axis indicates the position of each roller in the image forming apparatus in FIG. 1. The diagram illustrates how the recording materials 601 and 602 pass through each roller over time. The timing chart, which is illustrated below the diagram, illustrates the driving speed of each roller over time. In the present embodiment, the driving speed of each roller is set at a printing speed during image formation, whereas the driving speed of each roller is set at one-half the printing speed during detection of each of the color patches 603 and 604.

At the beginning of color correction control, the image forming controller 301 causes the image forming unit to be driven at the printing speed and causes the color patch 603 to be formed on the preceding recording material 601. At the time when the leading edge of the recording material 601 reaches the fixing device 13, the duplex reversing roller 30 is driven at the printing speed. The recording material 601 with the color patch fixed by the fixing device 13 is conveyed to the switch-back mechanism 29 by the duplex flapper 28.

At the time when the trailing edge of the recording material 601 reaches the duplex reversing roller 30 (701), the rotational direction of the duplex reversing roller 30 is reversed. At this time, the driving speed of the duplex reversing roller 30 is set at one-half the printing speed. In addition, the driving speed of the duplex conveying rollers 32 and the duplex re-feed roller 33 is also set at one-half the printing speed, and the recording material 601 is conveyed to the duplex conveying path 31. At this time, the driving speed of the photosensitive drum 5, the intermediate transfer belt 12, the registration roller 23, and the secondary transfer roller 9 remains at the printing speed to form the color patch 604 on the second recording material 602, which is to be conveyed subsequently. The driving speed can be maintained like this because the distance L605 from the leading edge of the recording material 601 to the last patch 12 in the color patch 603 is shorter than the distance from the detection location of the color sensor 42 to the secondary transfer portion, as previously described.

The color sensor 42 detects the color patch 603 on the recording material 601 being conveyed at one-half the printing speed (702). In parallel with the detection of the color patch 603 by the color sensor 42, the image forming controller 301 causes the color patch 604 to be formed on the recording material 602. As in the case of the recording material 601, when the trailing edge of the recording material 602 reaches the duplex reversing roller 30, the rotational direction of the duplex reversing roller 30 is reversed, and the recording material 602 is conveyed to the duplex conveying path 31. Then, before the leading edge of the recording material 601 reaches the registration roller 23, the driving speed of the registration roller 23 is switched to one-half the printing speed (703). This is because conveying the recording material 601 being conveyed at one-half the printing speed by the registration roller 23 driven at the printing speed would cause high tension in the recording material 601, depending on the difference in the conveying speed. This would lead to a reduction in the accuracy of detecting the color patch 603 on the recording material 601 by the color sensor 42. To avoid such a reduction, the driving speed is switched before the leading edge of the recording material 601 reaches the registration roller 23.

At the time when detecting the last patch 12 in the color patch 603 is completed (704), the image forming controller 301 switches the driving speed of the duplex re-feed roller 33 and the registration roller 23 to the printing speed. The recording material 601 is conveyed at the printing speed and discharged to outside the image forming apparatus.

Then, before the leading edge of the recording material 602 reaches the duplex re-feed roller 33, the driving speed of the duplex re-feed roller 33 is switched to one-half the printing speed (705). The color sensor 42 detects the color patch 604 on the recording material 602 (706). As in the case of the recording material 601, before the leading edge of the recording material 602 reaches the registration roller 23, the driving speed of the registration roller 23 is switched to one-half the printing speed (707). At the time when the detection of the last patch 24 in the color patch 604 is completed (708), the image forming controller 301 switches the driving speed of the duplex re-feed roller 33 and the registration roller 23 to the printing speed. The recording material 602 is conveyed at the printing speed and then discharged to outside the image forming apparatus, and the driving of the each roller is stopped (709). After that, the image forming condition is corrected on the basis of the detection by the color sensor 42, and the color correction control is completed.

Figure 9A:
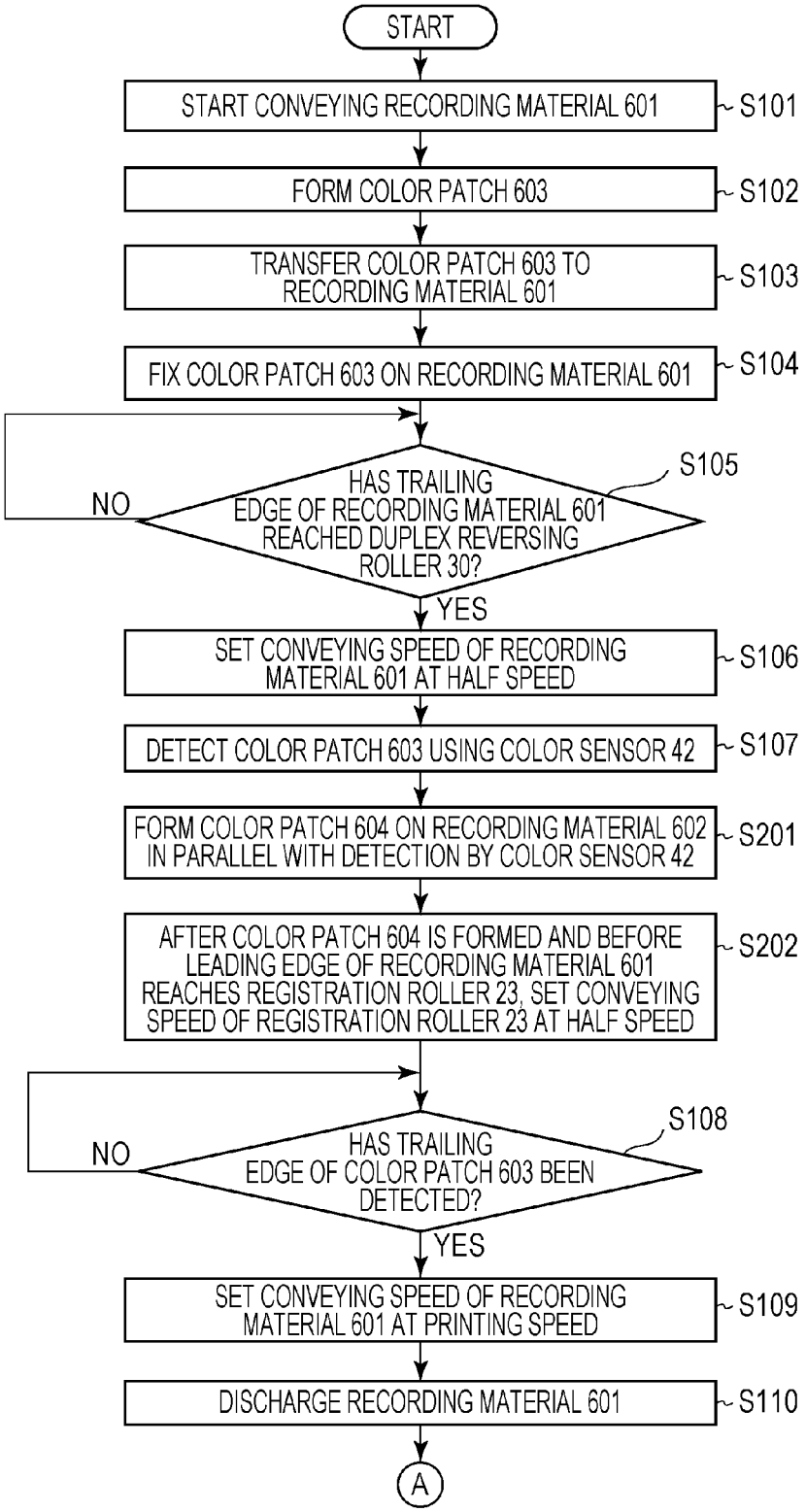
FIGS. 9A and 9B illustrate a flowchart of conveyance control for the recording materials in detecting the color patch.
Figure 9B:
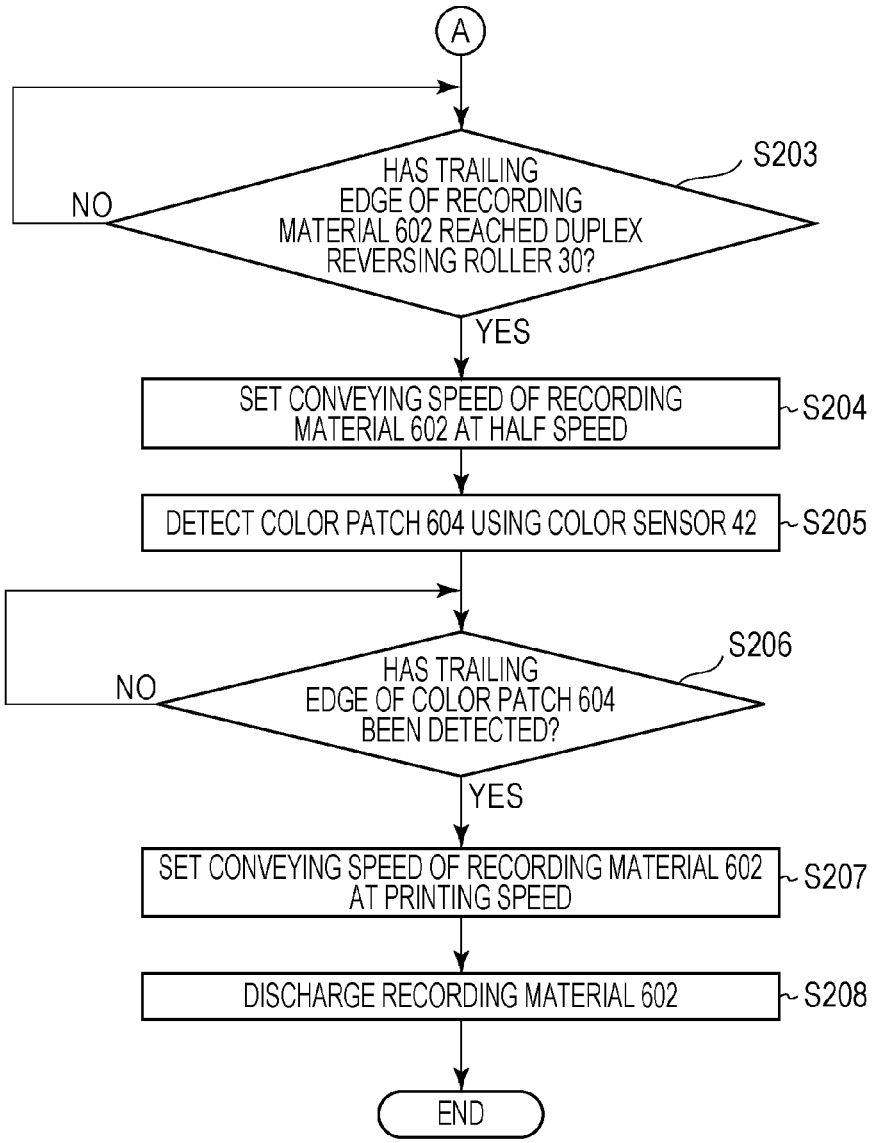

Flowchart of Conveyance Control for Recording Materials in Detecting Color Patch The color correction control according to the present embodiment is described below with reference to the flowchart in FIGS. 9A and 9B. The steps substantially the same as in the flowchart in FIG. 6 in the above first embodiment are denoted by the same numerals and are not described here.

Figure 6:
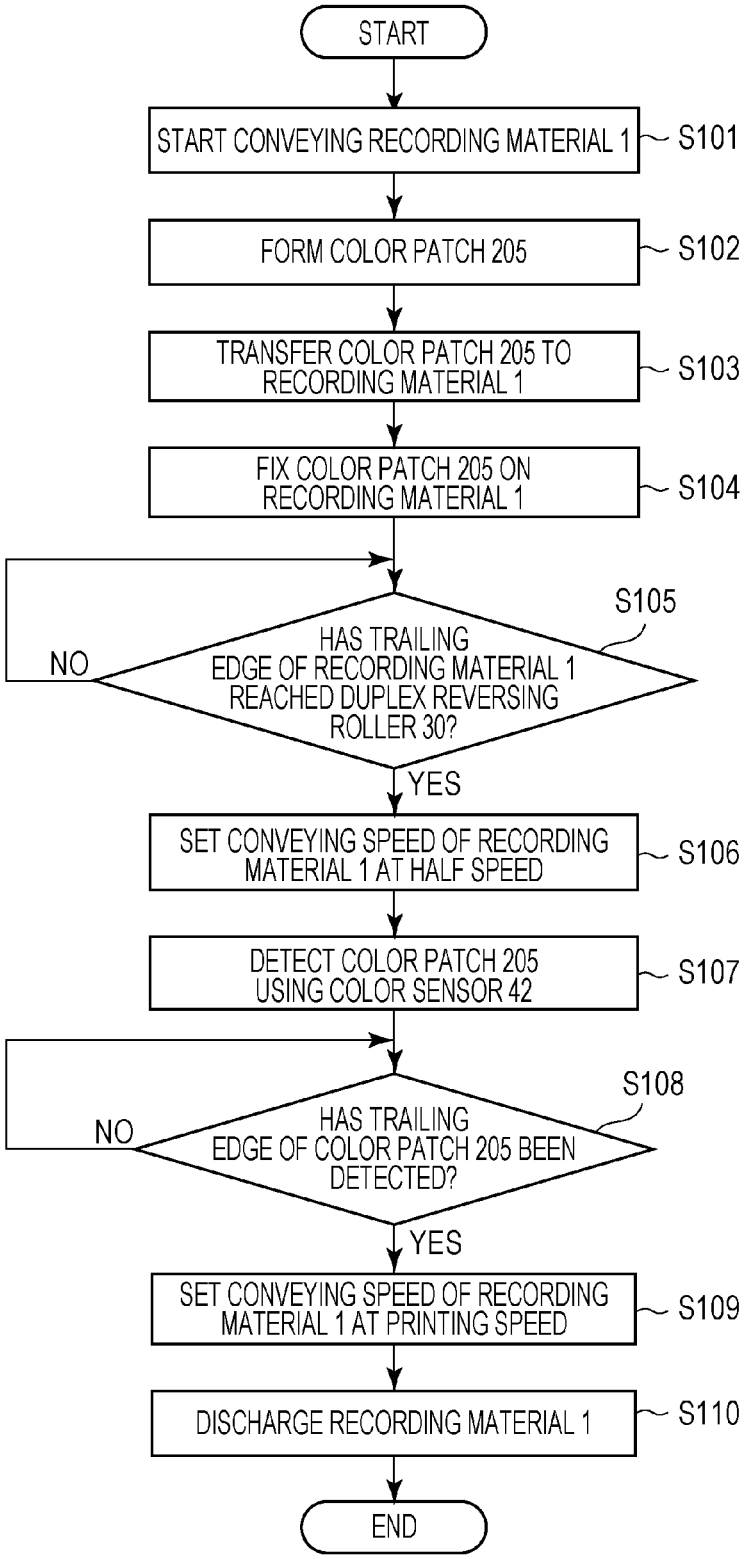
FIG. 6 is a flowchart that illustrates the conveyance control for the recording material in detecting the color patch.

S101 through S107 are substantially the same as in FIG. 6 and are not described here. At S201, the image forming controller 301 causes the color patch 604 to be formed on the recording material 602 in parallel with the detection of the color patch 603 on the recording material 601 by the color sensor 42. The method of forming the color patch 604 is substantially the same as the method described above with reference to FIG. 6 and is not described here.

At S202, after the color patch 604 is formed on the recording material 602 and before the leading edge of the recording material 601 reaches the registration roller 23, the image forming controller 301 switches the driving speed of the registration roller 23 to one-half the printing speed. Accordingly, the detection of the color patch 603 on the recording material 601 and the formation of the color patch 604 on the recording material 602 can be parallel with each other.

S108 through S110 are substantially the same as in FIG. 6 and are not described here. At S203, the image forming controller 301 determines whether the trailing edge of the recording material 602 with the color patch 604 fixed by the fixing device 13 has been conveyed to the duplex reversing roller 30. When the trailing edge of the recording material 602 is conveyed to the duplex reversing roller 30, at S204, the image forming controller 301 switches the conveying speed of the recording material 602 to one-half the printing speed. The recording material 602 is conveyed to the color sensor 42 at one-half the printing speed.

At S205, the image forming controller 301 causes the color sensor 42 to detect the color patch 604 on the recording material 602. At S206, the image forming controller 301 determines whether the trailing edge of the color patch 604 has been detected by the color sensor 42. When the trailing edge of the color patch 604 is detected, at S207, the image forming controller 301 switches the conveying speed of the recording material 602 to the printing speed. At S208, the image forming controller 301 causes the recording material 602 being conveyed at the printing speed to be discharged to outside the image forming apparatus. The image forming controller 301 corrects the image forming condition on the basis of the detection by the color sensor 42, and the color correction control is completed.

As described above, control is performed such that the detection of the color patch 603 on the recording material 601 and the formation of the color patch 604 on the recording material 602 are parallel with each other. Accordingly, the color patch can be detected with high accuracy by the color sensor 42, and the color patch can be formed on the recording material efficiently. Thus the time required for the color correction control can be reduced. In the case where a color patch is to be formed on three or more recording materials, discharging an Nth recording material to outside the image forming apparatus and then forming the color patch on an (N+2)th recording material enables the color patch to be formed and detected efficiently.

Third Embodiment

In the above second embodiment, a method of forming a color patch on two recording materials and detecting the color patch on each of the recording materials using the color sensor is described. In the present embodiment, a method for use in an image forming apparatus having the configuration in which three recording materials wait within the duplex conveying path is described. The method is the one of forming a color patch on three recording materials and detecting the color patch on each of the recording materials using the color sensor. The same configuration as in the above first or second embodiment is not described here.

Description of Color Patch

Figure 10:
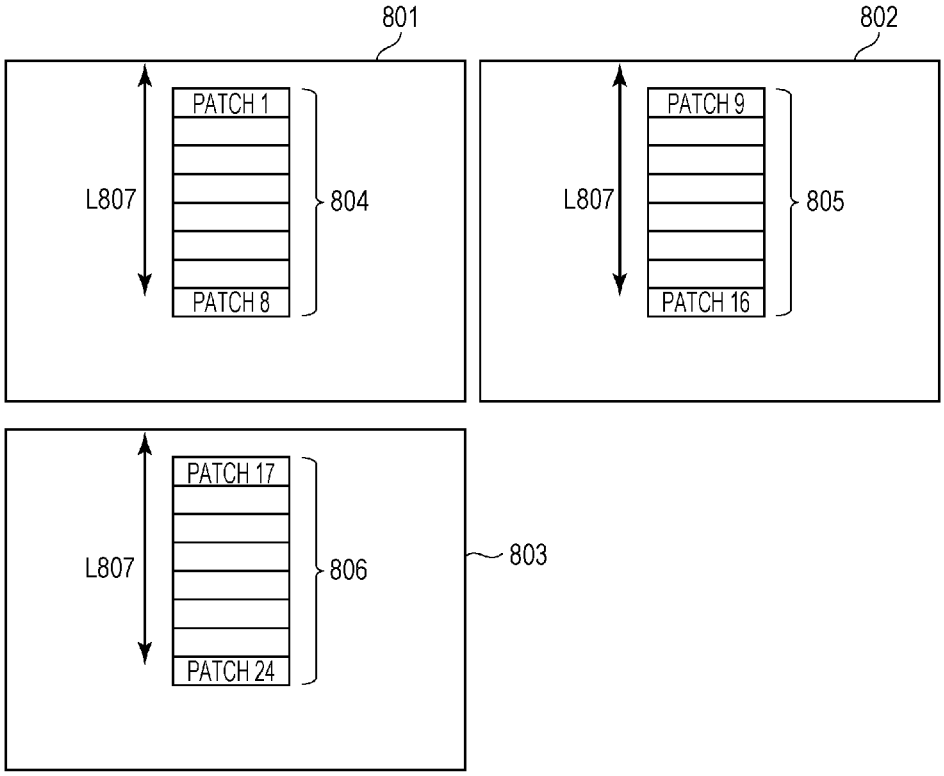
FIG. 10 illustrates a configuration of a color patch.

FIG. 10 illustrates a configuration of a color patch in the present embodiment. In the present embodiment, a method of forming a color patch on three recording materials is described as one example. The number of the recording materials on which the color patch is formed is not limited to three and may be more than three.

The color patch is divided into segments each having 8 patches and is formed on three recording materials. Here, for the sake of the description, the first recording material is referred to as a recording material 801, the segment of the color patch formed on the recording material 801 is referred to as a color patch 804, and the patches in the color patch 804 are referred to as patches 1 to 8. The second recording material is referred to as a recording material 802, the segment of the color patch formed on the recording material 802 is referred to as a color patch 805, and the patches in the color patch 805 are referred to as patches 9 to 16. The third recording material is referred to as a recording material 803, the segment of the color patch formed on the recording material 803 is referred to as a color patch 806, and the patches in the color patch 806 are referred to as patches 17 to 24. Here, the color patch made up of 24 patches is illustrated as one example. The number of the patches may be changed to any values depending on the desired detection accuracy.

The distance L807 from the leading edge of the recording material 801 to the last patch 8 in the color patch 804 is shorter than the distance from the detection location of the color sensor 42 to the merging location 34. The distance L807 from the leading edge of the recording material 802 to the last patch 16 in the color patch 805 is also shorter than the distance from the detection location of the color sensor 42 to the merging location 34. The distance L807 from the leading edge of the recording material 803 to the last patch 24 in the color patch 806 is also shorter than the distance from the detection location of the color sensor 42 to the merging location 34.

This aims to prevent the leading edge of the recording material 801 from extending beyond the merging location 34 when the recording material 801 is stopped within the duplex conveying path 31 after the color sensor 42 detects the color patch 804 on the recording material 801. Accordingly, the recording material 801 can be stopped within the duplex conveying path 31 without interfering with formation of the color patch on each of the subsequent recording materials 802 and 803.

Here, as one example, the length of the color patch formed on each of the recording materials 802 and 803 is also shorter than the distance from the detection location of the color sensor 42 to the merging location 34. If there is no recording material to be conveyed subsequently to the recording material 803, a color patch longer than the distance L807 may also be formed.

Figure 11:
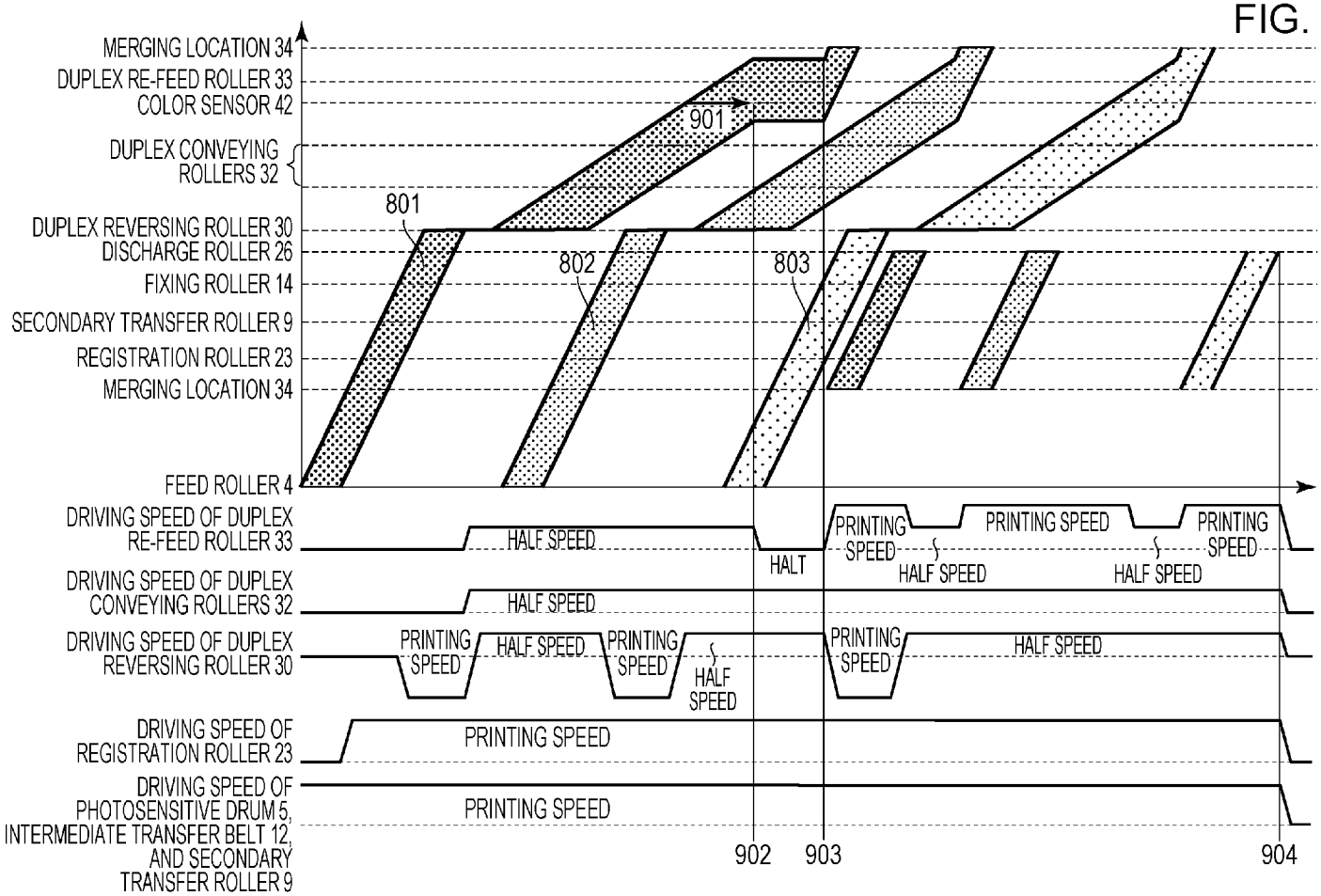
FIG. 11 illustrates a diagram and a timing chart for describing conveyance control for recording materials in detecting the color patch.

Description of Conveyance Control for Recording Materials in Detecting Color Patch FIG. 11 illustrates a diagram and a timing chart for describing conveyance control for the recording materials in detecting the color patch. In the diagram, the horizontal axis indicates the time and the vertical axis indicates the position of each roller in the image forming apparatus in FIG. 1. The diagram illustrates how the recording materials 801, 802, and 803 pass through each roller over time. The timing chart, which is illustrated below the diagram, illustrates the driving speed of each roller over time. In the present embodiment, the driving speed of each roller is set at a printing speed during image formation, whereas the driving speed of each roller is set at one-half the printing speed during detection of each of the color patches 804, 805, and 806.

At the beginning of color correction control, the image forming controller 301 causes the image forming unit to be driven at the printing speed and causes the color patch 804 to be formed on the recording material 801. When the color patch 804 is formed on the recording material 801, the color patch 805 is then formed on the recording material 802. When the color patch 805 is formed on the recording material 802, the color patch 806 is then formed on the recording material 803.

At the time when the trailing edge of the recording material 801 reaches the duplex reversing roller 30, the rotational direction of the duplex reversing roller 30 is reversed. At this time, the driving speed of the duplex reversing roller 30 is set at one-half the printing speed. In addition, the driving speed of the duplex conveying rollers 32 and the duplex re-feed roller 33 is also set at one-half the printing speed, and the recording material 801 is conveyed to the duplex conveying path 31. At this time, the driving speed of the photosensitive drum 5, the intermediate transfer belt 12, the registration roller 23, and the secondary transfer roller 9 remains at the printing speed to form the color patch 805 on the second recording material 802. The driving speed can be maintained like this because the distance L807 from the leading edge of the recording material 801 to the last patch 8 in the color patch 804 is shorter than the distance from the detection location of the color sensor 42 to the merging location 34, as previously described.

The color sensor 42 detects the color patch 804 on the recording material 801 being conveyed at one-half the printing speed (901). At the time when the last patch 8 in the color patch 804 is detected (902), the image forming controller 301 stops the duplex re-feed roller 33. At this time, because the leading edge of the recording material 801 is positioned before the merging location 34, driving the registration roller 23 can continue at the printing speed.

The image forming controller 301 causes the color patch 805 to be formed on the recording material 802 and in addition causes the color patch 806 to be formed on the recording material 803. When the trailing edge of the recording material 803 passes through the merging location 34 (903), the image forming controller 301 sets the conveying speed of the recording material 801 at the printing speed and causes the recording material 801 to be conveyed again. The recording material 801 is conveyed at the printing speed and then discharged to outside the image forming apparatus. The subsequent control for the recording materials 802 and 803 is substantially the same as in the above first embodiment and is not described here. After the recording material 803 is discharged to outside the image forming apparatus (904), driving each roller is stopped. After that, the image forming condition is corrected on the basis of the detection by the color sensor 42, and the color correction control is completed.

Figure 12A:
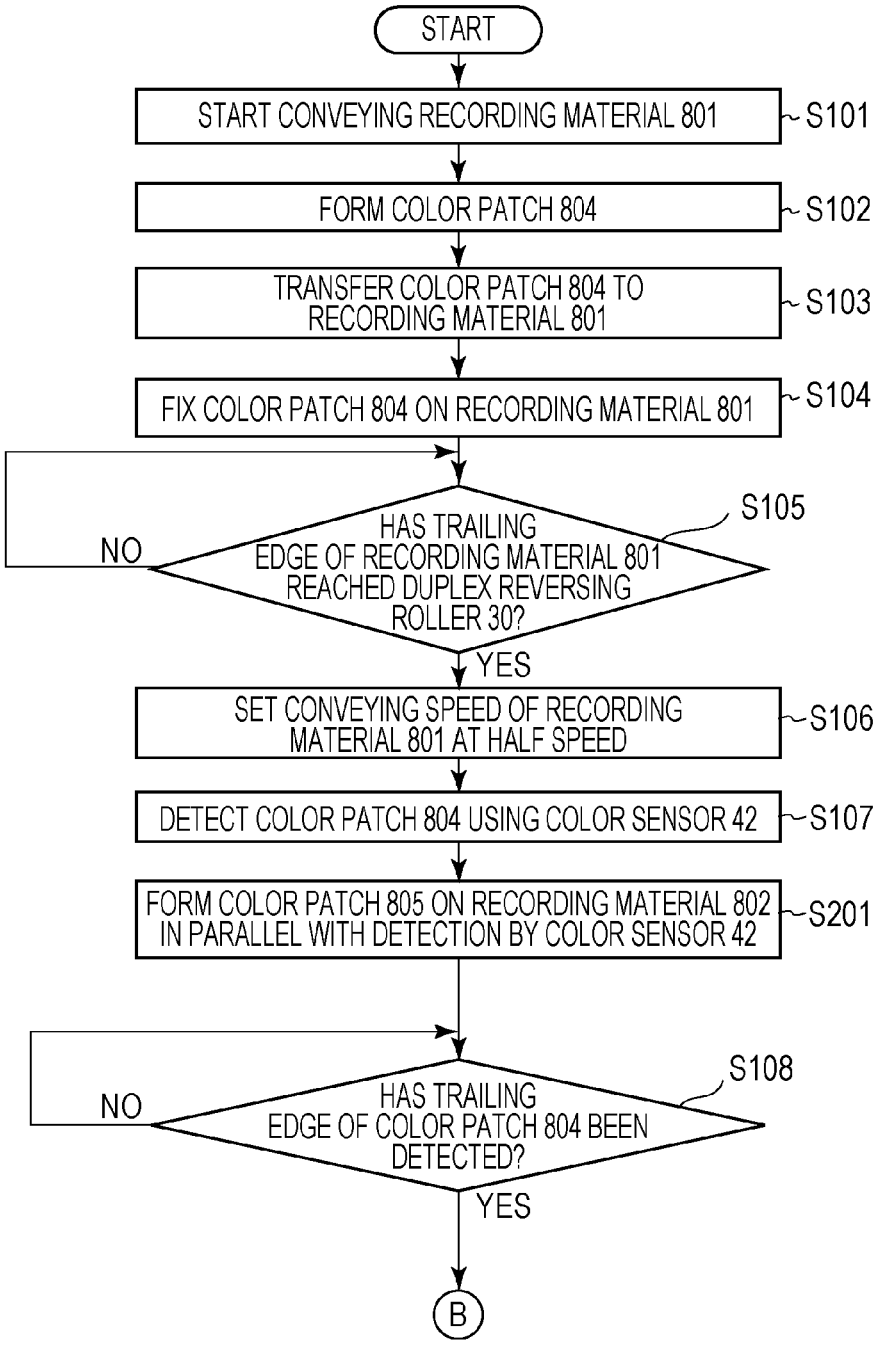
FIGS. 12A to 12C illustrate a flowchart of conveyance control for the recording materials in detecting the color patch.
Figure 12B:
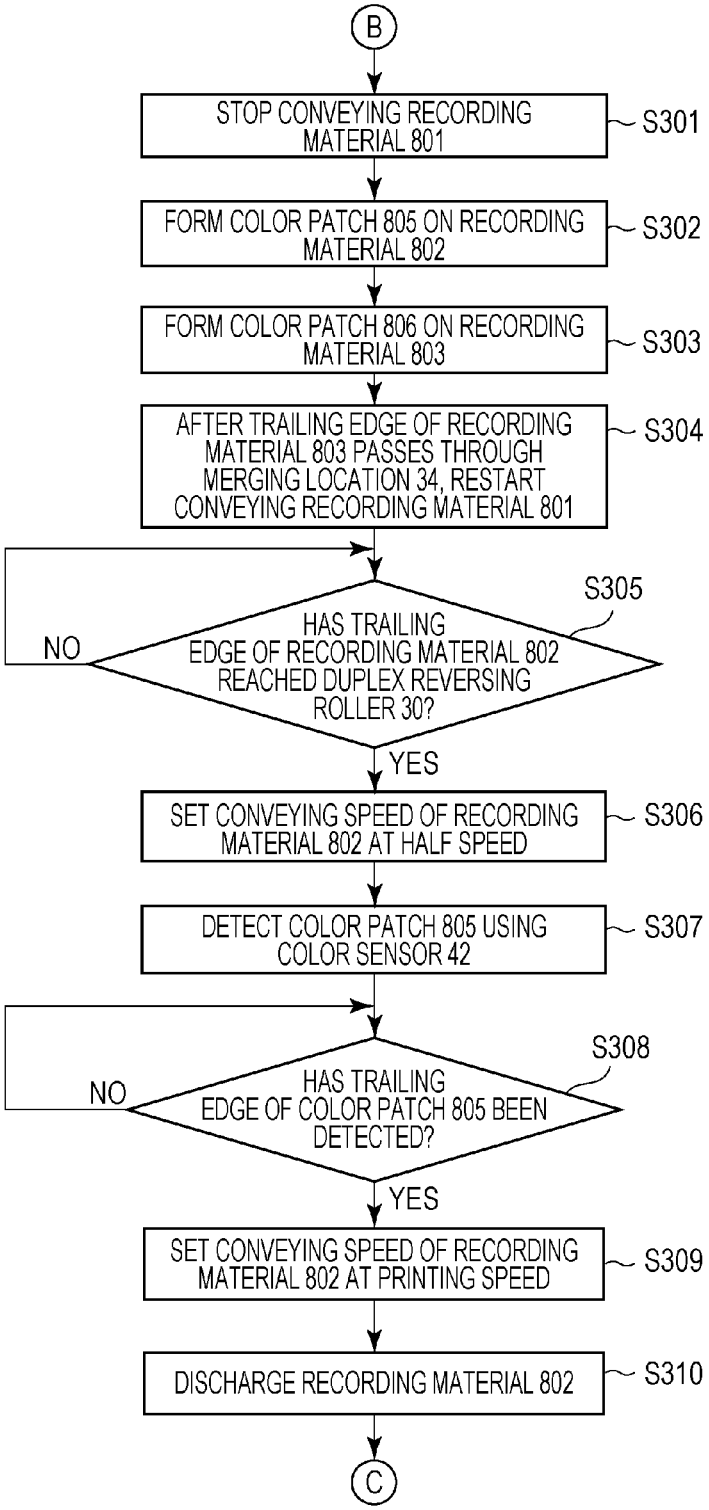
Figure 12C:
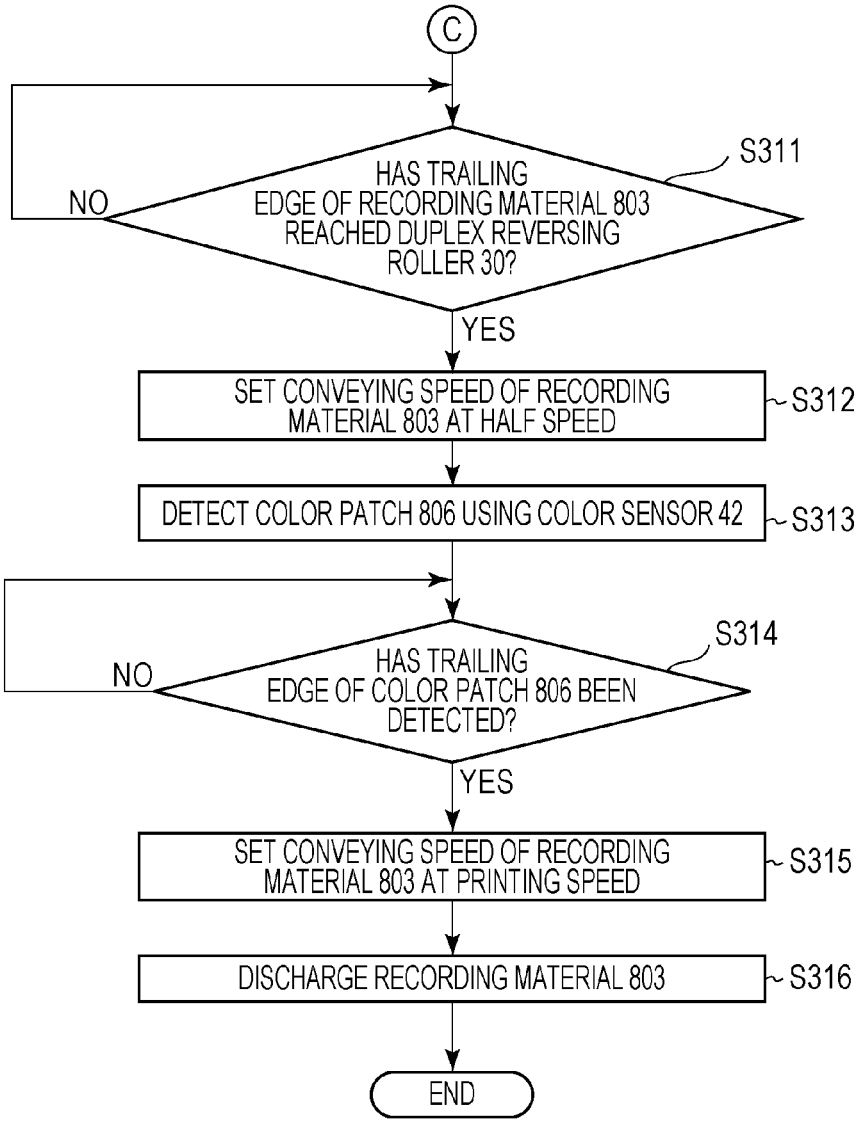

Flowchart of Conveyance Control for Recording Materials in Detecting Color Patch The color correction control according to the present embodiment is described below with reference to the flowchart in FIGS. 12A to 12C. The steps substantially the same as in the flowchart in FIG. 6 in the above first embodiment or the flowchart in FIGS. 9A and 9B in the above second embodiment are denoted by the same numerals and are not described here.

S101 through S108 are substantially the same as in the above flowcharts and are not described here. At S301, the image forming controller 301 stops conveying the recording material 801. When the recording material 801 is stopped, the leading edge of the recording material 801 does not extend beyond the merging location 34. Thus, the color patch can be continuously formed on each of the subsequent recording materials 802 and 803.

At S302, the image forming controller 301 cause the color patch 805 to be formed on the recording material 802. In addition, at S303, the image forming controller 301 causes the color patch 806 to be formed on the recording material 803. At S304, after the trailing edge of the recording material 803 passes through the merging location 34, the image forming controller 301 restarts conveying the recording material 801, which has been halted in the duplex conveying path 31. The subsequent S306 through S315 are substantially the same as S203 through S208 in the flowchart in FIG. 9B and are not described here.

As described above, after the completion of the detection of the color patch 804 on the recording material 801, the conveyance of the recording material 801 is stopped, and the color patch is formed on each of the recording materials 802 and 803, which are conveyed subsequently to the recording material 801. After the trailing edge of the recording material 803 passes through the merging location 34, the conveyance of the recording material 801 is restarted. Accordingly, the color patch can be continuously formed on three recording materials, and the time required for color correction control can be reduced. Because the color patch on each of the three recording materials is detected while the conveying speed of the recording material is set at a desired conveying speed, the color patch can be detected with high accuracy.

In the case where a color patch is to be formed on four or more recording materials, at the time when detection of the color patch on an Nth recording material is completed, conveyance of the Nth recording material is temporarily stopped. In response to the passage of an (N+2)th recording material through the merging location 34, the conveyance of the Nth recording material is restarted, the Nth recording material is then discharged to outside the image forming apparatus, and subsequently, the color patch is formed on an (N+3)th recording material. In this way, the color patch can be formed and detected efficiently.

The configuration(s) of the above-described embodiment(s) can reduce the time required for calibration.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-125714, filed Jun. 14, 2013, which is hereby incorporated by reference herein in its entirety.

What is claimed is:

1. An image forming apparatus comprising:

a forming unit configured to form a detection patch on a recording material; and a detecting unit configured to detect the detection patch on the recording material being conveyed at a first conveying speed, wherein, after the detecting unit detects the detection patch, the recording material with the detected detection patch is conveyed at a second conveying speed higher than the first conveying speed.

2. The image forming apparatus according to claim 1, wherein the conveying speed of the recording material while the forming unit forms the detection patch on the recording material is higher than the first conveying speed.

3. The image forming apparatus according to claim 1, wherein, after the forming unit forms the detection patch and before the detecting unit begins a detection process to detect the detection patch, the conveying speed of the recording material is set at the first conveying speed.

4. The image forming apparatus according to claim 1, further comprising: a correcting unit configured to correct an image formed by the forming unit based on the detection by the detecting unit.

5. The image forming apparatus according to claim 1, further comprising: a fixing unit configured to fix the detection patch on the recording material, wherein the detecting unit is disposed on a path through which the recording material passes after the fixing unit fixes the detection patch and before the recording material is discharged from the image forming apparatus.

6. The image forming apparatus according to claim 1, wherein the recording material with the detection patch detected by the detecting unit is conveyed at the second conveying speed and discharged from the image forming apparatus.

7. The image forming apparatus according to claim 1, wherein the forming unit is configured to form, as the detection patch, a single color toner image formed of a single color or a mixed color toner image formed by mixing a plurality of colors.

8. An image forming apparatus comprising:

a forming unit configured to form a first detection patch on a first recording material and subsequently form a second detection patch on a second recording material;

a detecting unit configured to detect the first detection patch on the first recording material at a duplex conveying path and subsequently detect the second detection patch on the second recording material at the duplex conveying path; and a conveying unit configured to convey each of the first and second recording materials to the forming unit, wherein a length from a leading edge of the first recording material to a last patch in the first detection patch is shorter than a length from a detection location of the detecting unit to the conveying unit, and wherein, while the first detection patch formed on the first recording material being conveyed in a first conveying speed is detected by the detecting unit, the second detection patch is formed by the forming unit on the second recording material being conveyed in a second conveying speed that is faster than the first conveying speed.

9. The image forming apparatus according to claim 8, wherein after the first detection patch is detected by the detecting unit, the first recording material is conveyed in a conveying speed being increased that is higher than the first conveying speed, or after the second detection patch is detected by the detecting unit, the second recording material is conveyed in a conveying speed being increased that is higher than the first conveying speed.

10. The image forming apparatus according to claim 8, wherein after the forming unit forms the first detection patch on the first recording material and before the detecting unit begins a detection process to detect the first detection patch, the first recording material is conveyed in the first conveying speed, or after the forming unit forms the second detection patch on the second recording material and before the detecting unit begins a detection process to detect the second detection patch, the second recording material is conveyed in the first conveying speed.

11. The image forming apparatus according to claim 8, further comprising: a correcting unit configured to correct an image formed by the forming unit based on the detection by the detecting unit.

12. The image forming apparatus according to claim 8, further comprising a fixing unit configured to fix the first and second detection patches on each of the first and second recording materials, wherein the detecting unit is disposed on a path through which each of the first and second recording materials passes after the fixing unit fixes the first and second detection patches and before each of the first and second recording materials is discharged from the image forming apparatus.

13. The image forming apparatus according to claim 8, wherein the first or second recording material with the first or second detection patches detected by the detecting unit is conveyed at the second conveying speed and discharged from the image forming apparatus.

14. The image forming apparatus according to claim 8, wherein the forming unit is configured to form, as the first and second detection patches, a single color toner image formed of a single color or a mixed color toner image formed by mixing a plurality of colors.

15. The image forming apparatus according to claim 8, wherein, in a case where the first recording material is reconveyed by the forming unit after the first detection patch is detected by the detecting unit, the first recording material is conveyed in the second conveying speed.

16. An image forming apparatus comprising:

a forming unit configured to form a first detection patch on a first recording material and subsequently form the second detection patch on a second recording material; and a detecting unit configured to detect the first detection patch on the first recording material at a duplex conveying path and subsequently detect the detection patch on the second recording material at the duplex conveying path, wherein the first recording material is conveyed at a first conveying speed and the second recording material is conveyed at a second conveying speed higher than the first conveying speed, wherein, after the first detection patch on the preceding first recording material is detected by the detecting unit, conveyance of the first recording material is stopped in the duplex conveying path, and wherein, after the detection patch is formed by the forming unit on the second recording material, the first recording material is conveyed again in a conveying speed higher than the first conveying speed.

17. The image forming apparatus according to claim 16, wherein a length from a leading edge of each of the first recording material to a last patch in the first detection patch is shorter than a length from a detection location of the detecting unit to a merging location at which a single-sided conveying path and the duplex conveying path meet.

18. The image forming apparatus according to claim 16, wherein after the first detection patch is detected by the detecting unit, the first recording material is conveyed in a conveying speed being increased that is higher than the first conveying speed, or after the second detection patch is detected by the detecting unit, the second recording material is conveyed in a conveying speed being increased that is higher than the first conveying speed.

19. The image forming apparatus according to claim 16, wherein after the forming unit forms the first detection patch on the first recording material and before the detecting unit begins a detection process to detect the first detection patch, the first recording material is conveyed in the first conveying speed, or after the forming unit forms the second detection patch on the second recording material and before the detecting unit begins a detection process to detect the second detection patch, the second recording material is conveyed in the first conveying speed.

20. The image forming apparatus according to claim 16, further comprising a correcting unit configured to correct an image formed by the forming unit based on the detection by the detecting unit.

21. The image forming apparatus according to claim 16, further comprising a fixing unit configured to fix the first and second detection patches on each of the first and second recording materials, wherein the detecting unit is disposed on a path through which each of the first and second recording materials passes after the fixing unit fixes the first and second detection patches and before each of the first and second recording materials is discharged from the image forming apparatus.

22. The image forming apparatus according to claim 16, wherein the first or second recording material with the first or second detection patches detected by the detecting unit is conveyed at the second conveying speed and discharged from the image forming apparatus.

23. The image forming apparatus according to claim 16, wherein the forming unit is configured to form, as the first and second detection patches, a single color toner image formed of a single color or a mixed color toner image formed by mixing a plurality of colors.

* * * * *